US008164017B2

(12) United States Patent
Cheng

(10) Patent No.: US 8,164,017 B2
(45) Date of Patent: Apr. 24, 2012

(54) KEY STRUCTURE AND KEYBOARD HAVING SUCH KEY STRUCTURE

(75) Inventor: Yu-Chih Cheng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 323 days.

(21) Appl. No.: 12/630,127

(22) Filed: Dec. 3, 2009

(65) Prior Publication Data

US 2011/0073455 A1 Mar. 31, 2011

(30) Foreign Application Priority Data

Sep. 25, 2009 (TW) ..... 98132393 A

(51) Int. Cl.
*H01H 13/7065* (2006.01)

(52) U.S. Cl. ..... 200/344

(58) Field of Classification Search ..... 200/5 A, 200/344, 345; 400/490–496
See application file for complete search history.

(56) References Cited

U.S. PATENT DOCUMENTS

| | | | | |
|---|---|---|---|---|
| 5,898,145 | A * | 4/1999 | Su | 200/344 |
| 6,392,176 | B1 * | 5/2002 | Tsai | 200/344 |
| 6,550,993 | B2 * | 4/2003 | Lu et al. | 400/490 |
| 6,642,466 | B1 * | 11/2003 | Lu | 200/344 |
| 7,173,200 | B2 * | 2/2007 | Yoneyama | 200/5 A |
| 7,385,149 | B2 * | 6/2008 | Liu | 200/5 A |
| 2003/0044214 | A1 * | 3/2003 | Lu et al. | 400/490 |
| 2003/0188960 | A1 * | 10/2003 | Hsu | 200/344 |
| 2010/0140071 | A1 * | 6/2010 | Wang | 200/344 |
| 2010/0155209 | A1 * | 6/2010 | Cheng | 200/344 |

* cited by examiner

*Primary Examiner* — Michael Friedhofer
(74) *Attorney, Agent, or Firm* — Apex Juris, pllc; Tracy M. Heims

(57) ABSTRACT

A key structure and a keyboard including multiple key structures are provided. The key structure includes a keycap, a base plate and a scissors-type support member between the keycap and the base plate. The scissors-type support member includes an inner frame having a convex part and an outer frame having a recess. The convex part is accommodated within the recess. By controlling relative positions between the convex part and the recess, the keycap is stably moved in the vertical direction.

9 Claims, 8 Drawing Sheets

KEY STRUCTURE AND KEYBOARD HAVING SUCH KEY STRUCTURE

FIELD OF THE INVENTION

The present invention relates to a key structure, and more particularly to a key structure for use in a keyboard.

BACKGROUND OF THE INVENTION

A keyboard is a widely-used input device of a computer. Generally, a keyboard has a plurality of key structures. FIG. 1 is a schematic perspective view illustrating a key structure of a keyboard according to the prior art. When the key structure 1 is depressed, a corresponding switch is triggered to generate an electronic signal to the computer.

FIG. 2 is a schematic exploded view illustrating a key structure according to the prior art. As shown in FIG. 2, the key structure 1 comprises a keycap 11, a scissors-type support member, an elastic element 14, a membrane switch 15 and a base plate 16. The scissors-type support member comprises an inner frame 12 and an outer frame 13. The inner frame 12 and the outer frame 13 cooperate with each other to fix the keycap 11 on the base plate 16. The membrane switch 15 is disposed on the base plate 16. The elastic element 14 is arranged between the keycap 11 and the membrane switch 15. When the keycap 11 is depressed, the elastic element 14 is deformed downwardly to trigger the membrane switch 15 such that the membrane switch 15 generates an electronic signal. In designing the scissors-type support member, the keycap 11 should be returned to its original position after the depressing force exerted on the keycap 11 is eliminated. Generally, the elastic element 14 provides the restoring force to push the keycap 11 back to its original position. Moreover, the inner frame 12 and the outer frame 13 should cooperate with each other in order to precisely control the upward moving action of the keycap 11. In other words, the configurations of the inner frame 12 and the outer frame 13 are very important factors that influence the quality and the use life of the key structure 1.

Please refer to FIG. 2 again. Two pivot rods 121 are formed on the arm part of the inner frame 12. Corresponding to the pivot rods 121, two pivot holes 131 are formed on an arm part of the outer frame 13. The pivot rods 121 are pivotally coupled with the pivot holes 131 such that the inner frame 12 is rotatable on the outer frame 13. For combining the inner frame 12 with the outer frame 13, the user needs to prop open the arm part of the outer frame 13 to widen the distance between these two pivot holes 131. As such, the pivot rods 121 could be successfully inserted into corresponding pivot holes 131 so as to combine the inner frame 12 and the outer frame 13 together. The process of propping open the outer frame 13 is time-consuming and thus detrimental to the throughput of the keyboard. On the other hand, if the external force used to prop open the outer frame 13 is improper, the outer frame 13 is readily damaged and the yield is reduced.

Please refer to FIG. 2 again. After the inner frame 12 and the outer frame 13 of the conventional key structure 1 are combined together, the pivot rods 121 are pivotally coupled with the pivot holes 131. For maintaining stability of the keycap 11 and preventing from the rocking condition of the keycap 11 during the keycap 11 is depressed or returned to its original position, the pivot rods 121 need to be tightly fitted into corresponding pivot holes 131. Since the pivot rods 121 are tightly fitted into corresponding pivot holes 131, a strong friction force is generated when the inner frame 12 is rotated with respect to the outer frame 13. Under this circumstance, the tactile feel upon depressing the keycap 11 is deteriorated. After the keycap 11 has been depressed for many times, the regions between the pivot rods 121 of the inner frame 12 and the pivot holes 131 of the outer frame 13 are readily abraded by the friction force. That is, the pivot rods 121 will no longer be tightly fitted into corresponding pivot holes 131. Finally, the keycap 11 is unstable and easily rocked.

Therefore, there is a need of providing a scissors-type support member capable of maintaining stable movement of the keycap and achieving a desired tactile feel when the keycap is depressed. Moreover, the inner frame and the outer frame of the scissors-type support member should be easily assembled without the need of propping open the outer frame.

SUMMARY OF THE INVENTION

It is an object of the present invention to provide a key structure whose scissors-type support member could keep stable movement of the keycap and achieve a desired tactile feel when the keycap is depressed.

Another object of the present invention provides a key structure whose scissors-type support member is easily assembled.

In accordance with an aspect of the present invention, there is provided a key structure. The key structure includes a keycap, a base plate and a scissors-type support member. The scissors-type support member is used for connecting the keycap with the base plate. The scissors-type support member includes an inner frame and an outer frame. The inner frame has a first convex part and an internally-concave V-shaped notch formed on an arm part of the inner frame. The first convex part includes a first inclined surface and a first bottom surface. The outer frame has an internally-concave recess and a second convex part formed on an arm part of the outer frame. The recess includes a second bottom surface and a second inclined surface. When the keycap is located at a first height with respect to the base plate, the first inclined surface is sustained against the second inclined surface. Whereas, when the keycap is located at a second height with respect to the base plate, the first bottom surface is sustained against the second bottom surface.

In an embodiment of the key structure, the second convex part is a triangular prism having a fifth inclined surface extended from the second inclined surface. The triangular prism is accommodated within the V-shaped notch. The V-shaped notch has a third inclined surface extended from the first inclined surface. The fifth inclined surface is sustained against the third inclined surface when the keycap is located at the first height.

In an embodiment of the key structure, the triangular prism further includes a sixth inclined surface. The V-shaped notch further includes a fourth inclined surface. The sixth inclined surface is sustained against the fourth inclined surface when the keycap is located at the second height.

In an embodiment of the key structure, the key structure further includes a membrane switch and an elastic element. The membrane switch is disposed on the base plate. The elastic element is arranged between the keycap and the membrane switch. The membrane switch is triggered by the elastic element when the keycap is depressed to be moved from the first height to the second height.

In an embodiment of the key structure, a first connecting part and a guiding slot are formed on a bottom of the keycap, a second connecting part and a hook are formed on the base plate, a first coupling shaft and a first gliding shaft are formed on both terminals of the arm part of the inner frame, and a second coupling shaft and a second gliding shaft are formed on both terminals of the arm part of the outer frame. Via the engagement between the hook and the second gliding shaft and the engagement between the second coupling shaft and the first connecting part, the scissors-type support member is fixed on the base plate. Via the engagement between the guiding slot and the first gliding shaft and the engagement between the first connecting part and the second coupling shaft, the keycap is combined with the scissors-type support member.

In accordance with another aspect of the present invention, there is provided a keyboard. The keyboard includes multiple keycaps, a base plate, a plurality of scissors-type support members, a plurality of membrane switches, and a plurality of elastic elements. The scissors-type support members are used for connecting the keycaps with the base plate. Each of the scissors-type support members includes an inner frame and an outer frame. The inner frame has a first convex part and an internally-concave V-shaped notch formed on an arm part of the inner frame. The first convex part includes a first inclined surface and a first bottom surface. The outer frame has an internally-concave recess and a second convex part formed on an arm part of the outer frame. The recess includes a second bottom surface and a second inclined surface. When the keycap is located at a first height with respect to the base plate, the first inclined surface is sustained against the second inclined surface. Whereas, when the keycap is located at a second height with respect to the base plate, the first bottom surface is sustained against the second bottom surface. The membrane switches are disposed on the base plate. The elastic elements are arranged between respective keycaps and respective membrane switches. The membrane switches are triggered by the elastic elements when corresponding keycaps are depressed to be moved from the first height to the second height.

In an embodiment of the keyboard, the second convex part is a triangular prism having a fifth inclined surface extended from the second inclined surface. The triangular prism is accommodated within the V-shaped notch. The V-shaped notch has a third inclined surface extended from the first inclined surface. The fifth inclined surface is sustained against the third inclined surface when the keycap is located at the first height.

In an embodiment of the keyboard, the triangular prism further includes a sixth inclined surface. The V-shaped notch further includes a fourth inclined surface. The sixth inclined surface is sustained against the fourth inclined surface when the keycap is located at the second height.

In an embodiment of the keyboard, the key structure further includes a membrane switch and an elastic element. The membrane switch is disposed on the base plate. The elastic element is arranged between the keycap and the membrane switch. The membrane switch is triggered by the elastic element when the keycap is depressed to be moved from the first height to the second height.

In an embodiment of the keyboard, a first connecting part and a guiding slot are formed on a bottom of the keycap, a second connecting part and a hook are formed on the base plate, a first coupling shaft and a first gliding shaft are formed on both terminals of the arm part of the inner frame, and a second coupling shaft and a second gliding shaft are formed on both terminals of the arm part of the outer frame. Via the engagement between the hook and the second gliding shaft and the engagement between the second coupling shaft and the first connecting part, the scissors-type support member is fixed on the base plate. Via the engagement between the guiding slot and the first gliding shaft and the engagement between the first connecting part and the second coupling shaft, the keycap is combined with the scissors-type support member.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
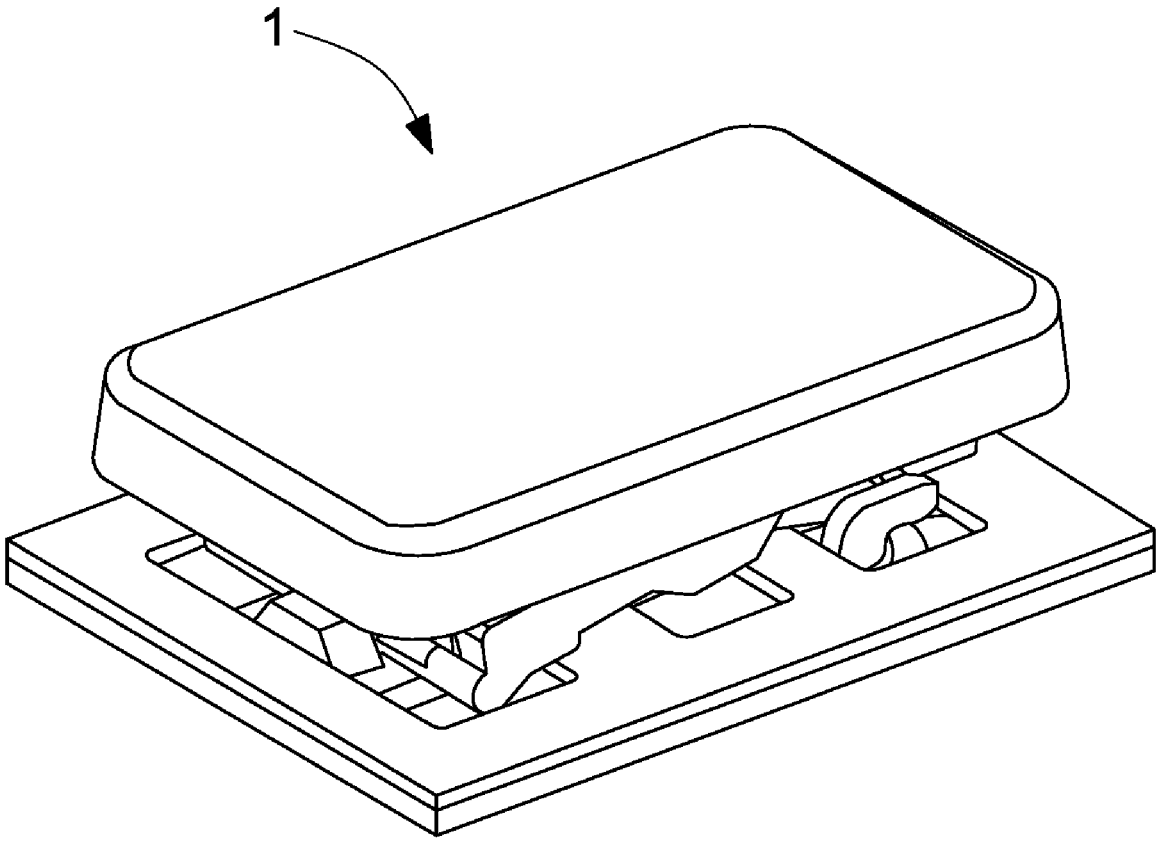
FIG. 1 is a schematic perspective view illustrating a key structure of a keyboard according to the prior art.
Figure 2:
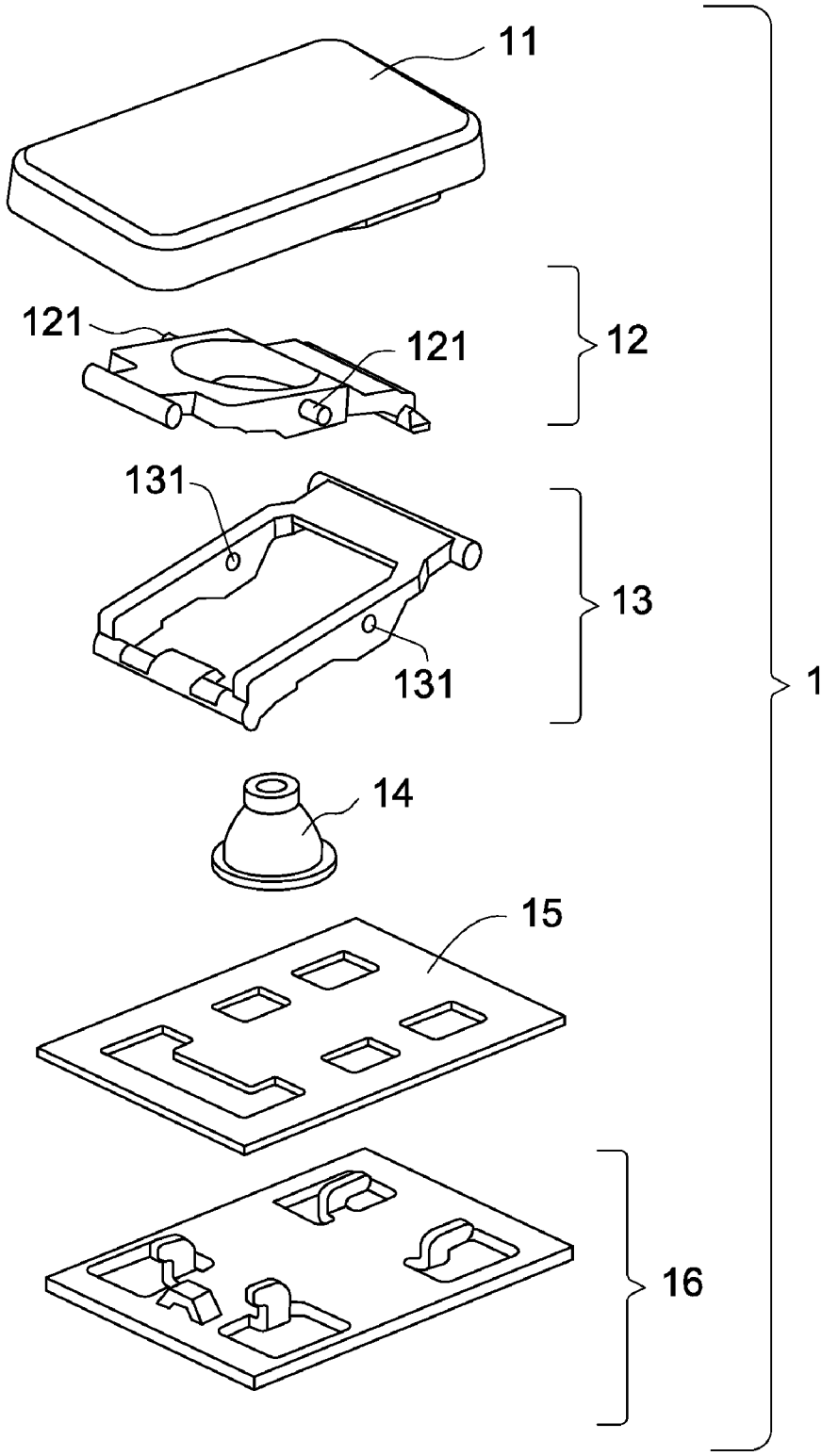
FIG. 2 is a schematic exploded view illustrating a key structure according to the prior art.
Figure 3:
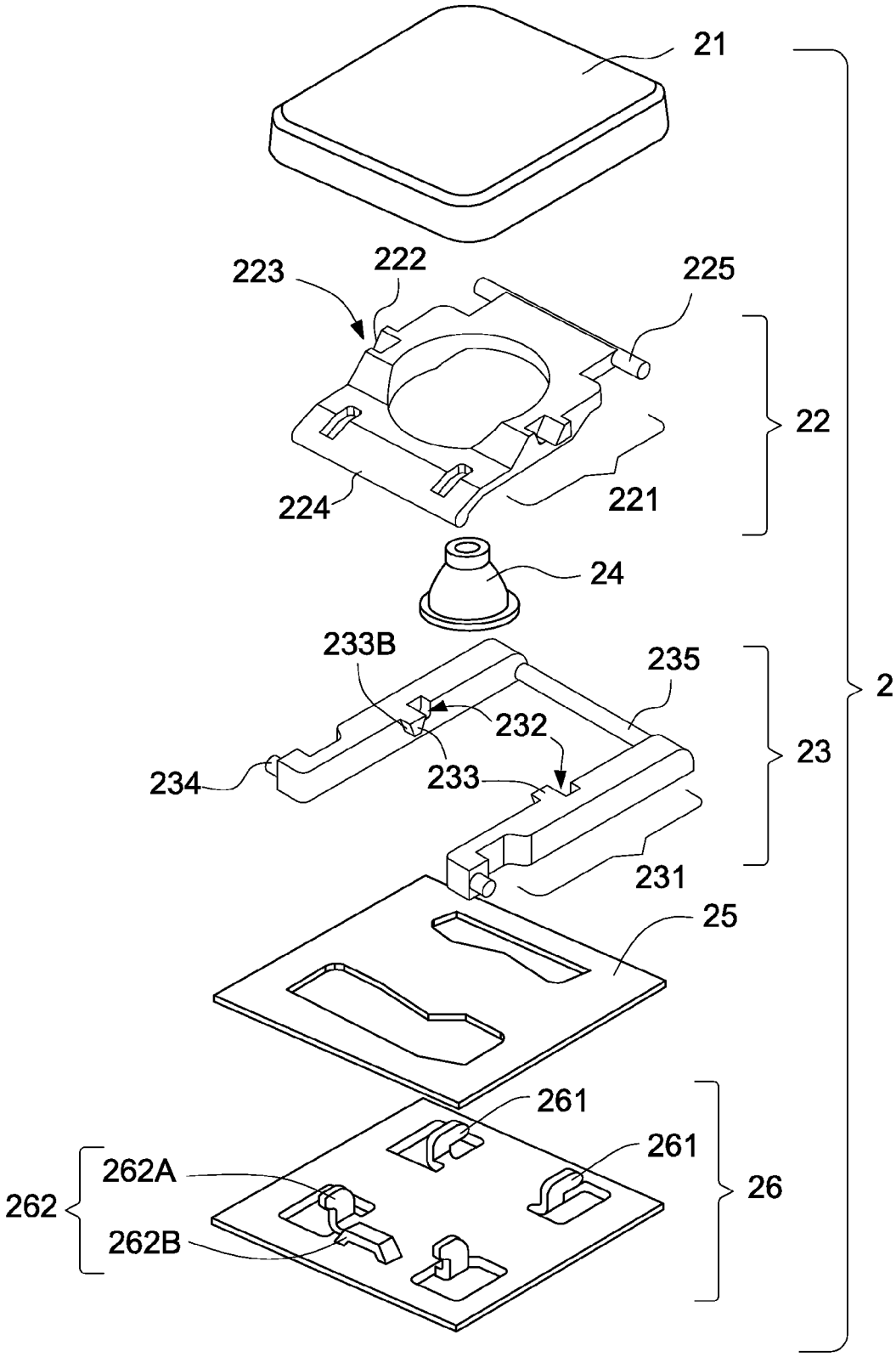
FIG. 3 is a schematic exploded view illustrating a key structure according to a preferred embodiment of the present invention.

FIG. 3 is a schematic exploded view illustrating a key structure according to a preferred embodiment of the present invention. As shown in FIG. 3, the key structure 2 comprises a keycap 21, a scissors-type support member, an elastic element 24, a membrane switch 25 and a base plate 26. The scissors-type support member comprises an inner frame 22 and an outer frame 23. The inner frame 22 and the outer frame 23 cooperate with each other to fix the keycap 21 on the base plate 26. The membrane switch 25 is disposed on the base plate 26. The elastic element 24 is arranged between the keycap 21 and the membrane switch 25. When the keycap 21 is depressed, the elastic element 24 is deformed downwardly to trigger the membrane switch 25 such that the membrane switch 25 generates an electronic signal. By means of the elastic element 24, the keycap 21 could be returned to its original position where the keycap 21 is not depressed. Moreover, the base plate 26 has a hook 261 and a second connecting part 262. The second connecting part 262 comprises a hook 262A and a stopper 262B.

Figure 4A:
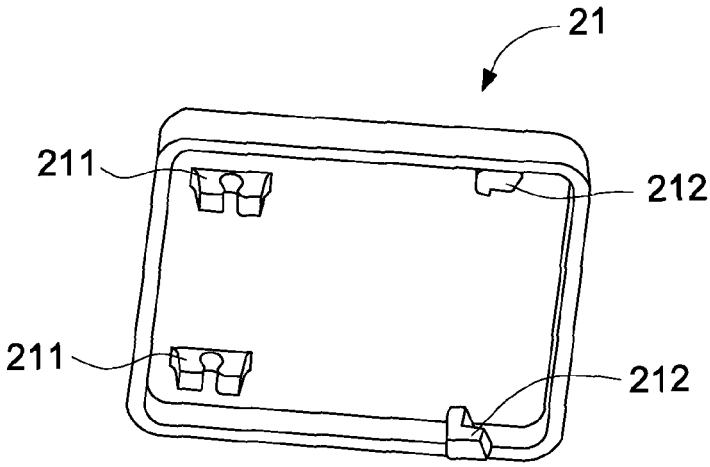
FIG. 4A is a schematic perspective view illustrating the keycap of the key structure according to the preferred embodiment of the present invention.
Figure 4B:
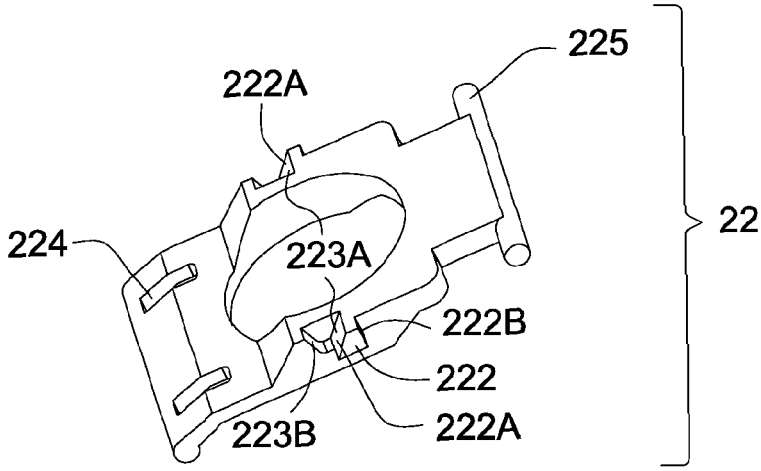
FIG. 4B is a schematic perspective view illustrating the inner frame of the key structure according to the preferred embodiment of the present invention.
Figure 4C:
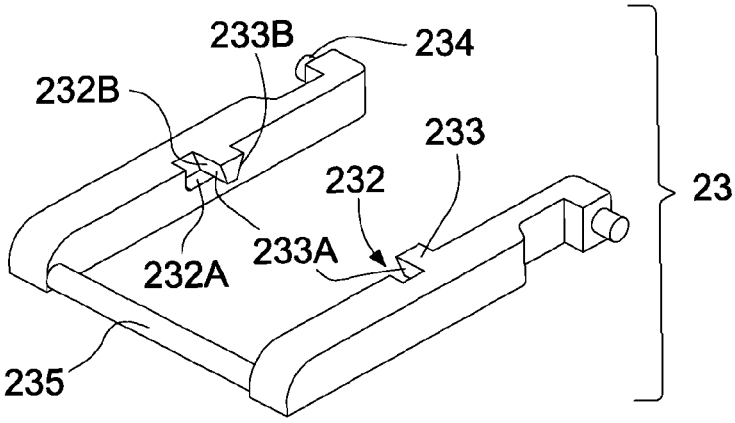
FIG. 4C is a schematic perspective view illustrating the inner frame of the outer frame according to the preferred embodiment of the present invention.

FIGS. 4A, 4B and 4C are schematic perspective views illustrating the keycap 21, the inner frame 22 and the outer frame 23 of the key structure 2 according to an embodiment of the present invention, respectively. Hereinafter, the configurations of the key structure 2 will be illustrated in more details with reference to FIGS. 4A, 4B and 4C.

As shown in FIG. 4A, a first connecting part 211 and a guiding slot 212 are formed on the bottom of the keycap 21. As shown in FIG. 4B, a first convex part 222 and an internally-concave V-shaped notch 223 are formed on an arm part 221 of the inner frame 22. The first convex part 222 has a first inclined surface 222A and a first bottom surface 222B. The V-shaped notch 223 comprises a third inclined surface 223A and a fourth inclined surface 223B. The third inclined surface 223A is extended from the first inclined surface 222A. In addition, a first coupling shaft 224 and a first gliding shaft 225 are formed on both terminals of the arm part 221 of the inner frame 22. As shown in FIG. 4C, an internally-concave recess 232 and a second convex part 233 are formed on an arm part 231 of the outer frame 23. The recess 232 comprises a second bottom surface 232A and a second inclined surface 232B. In this embodiment, the second convex part 233 is a triangular prism. The second convex part 233 comprises a fifth inclined surface 233A and a sixth inclined surface 233B. The fifth inclined surface 233A is extended from the second inclined surface 232B. In addition, a second coupling shaft 234 and a second gliding shaft 235 are formed on both terminals of the arm part 231 of the outer frame 23.

Figure 5A:
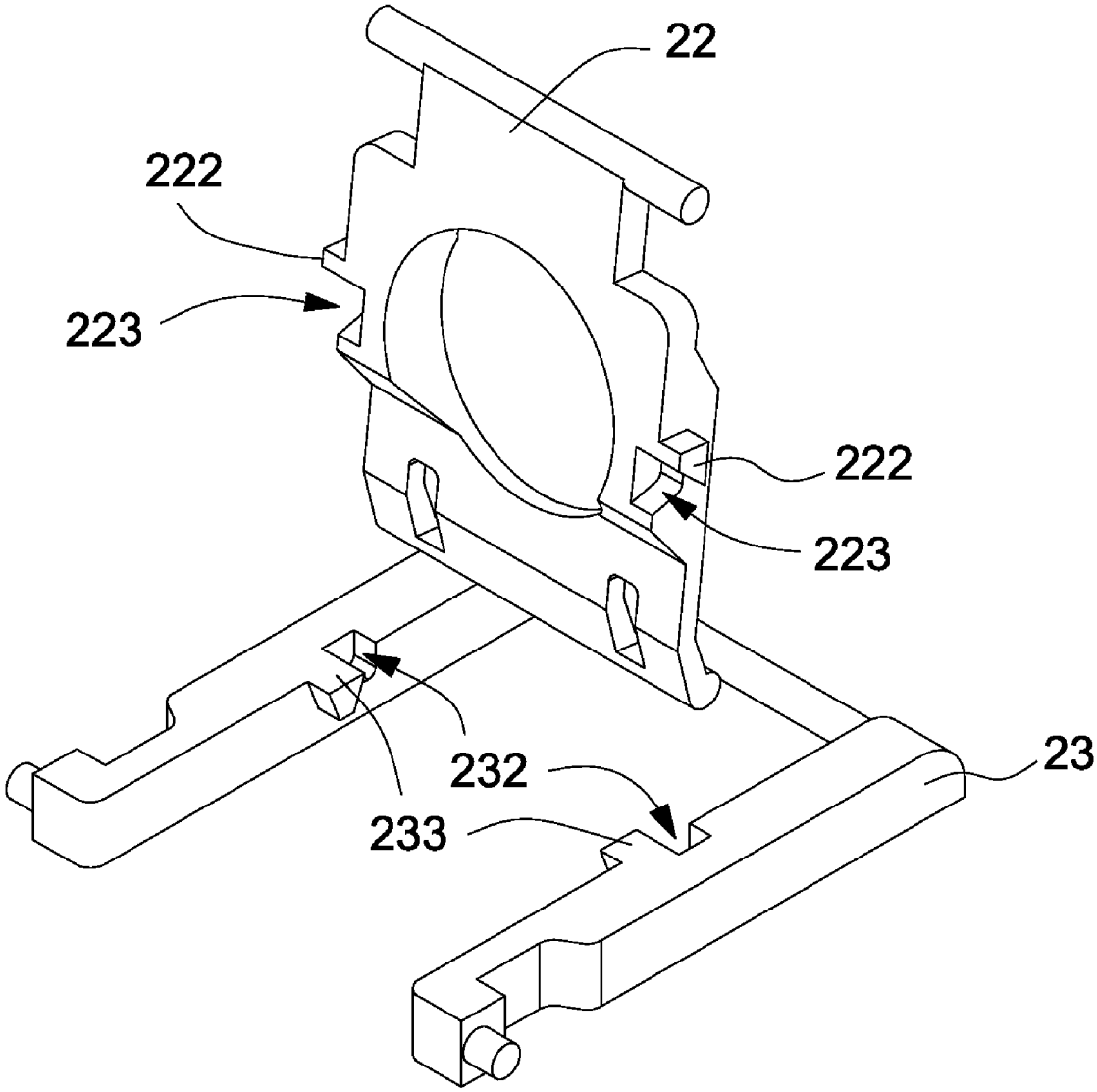
FIGS. 5A, 5B and 5C schematically illustrate a process of assembling the inner frame and the outer frame of the scissors-type support member of the key structure according to the preferred embodiment of the present invention.
Figure 5B:
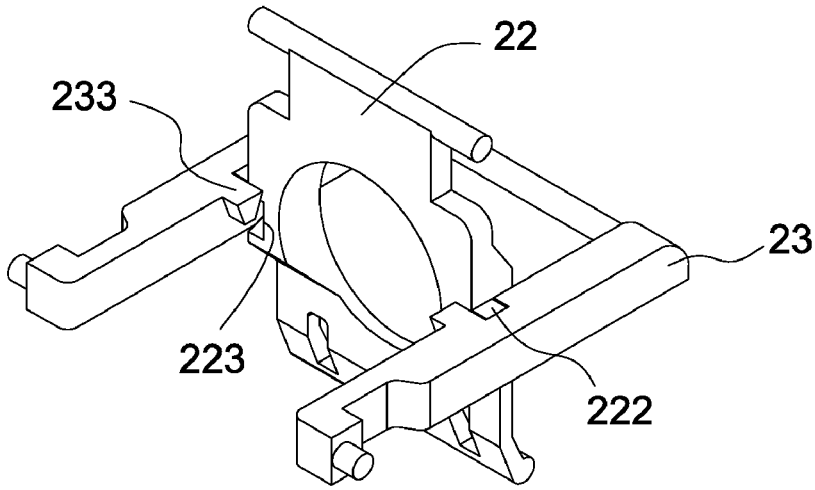
Figure 5C:
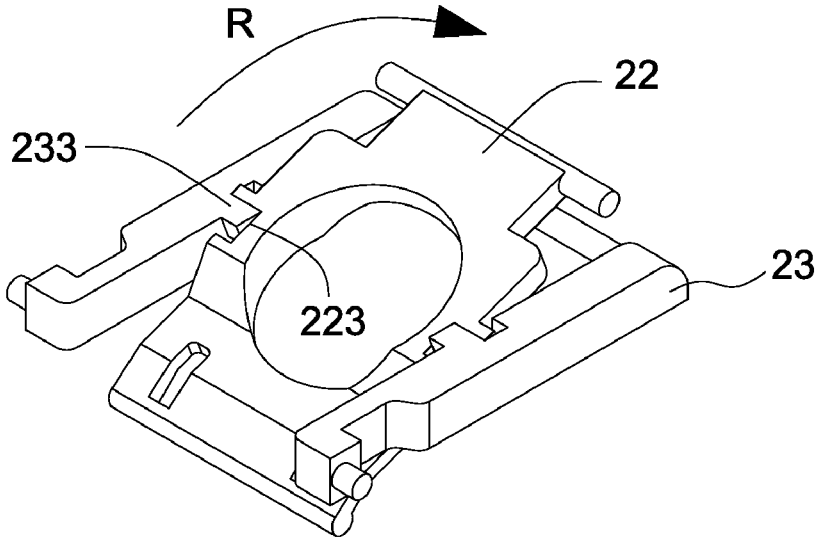

Hereinafter, the process of assembling the inner frame and the outer frame of the scissors-type support member of the key structure will be illustrated with reference to FIGS. 5A, 5B and 5C. First of all, as shown in FIG. 5A, the inner frame 22 is aligned with the outer frame 23 in a crisscrossing manner. Next, as shown in FIG. 5B, the first convex part 222 of the inner frame 22 is inserted into the recess 232 of the outer frame 23 such that the entrance of the V-shaped notch 223 of the inner frame 22 faces to the second convex part 233 of the outer frame 23. Next, as shown in FIG. 5C, the inner frame 22 is turned over in the direction indicated as the arrow R. As such, the first convex part 222 of the inner frame 22 is accommodated within the recess 232 of the outer frame 23 and the second convex part 233 of the outer frame 23 is accommodated within the V-shaped notch 223 of the inner frame 22, thereby assembling the scissors-type support member of the key structure 2. Meanwhile, the first inclined surface 222A of the first convex part 222 of the inner frame 22 is sustained against the second inclined surface 232B of the recess 232 of the outer frame 23.

In this embodiment, the scissors-type support member is very easily assembled by combining the first convex part 222 and the V-shaped notch 223 of the inner frame 22 with the recess 232 and the second convex part 233 of the outer frame 23, respectively. Since the user needs not to prop open the outer frame 23 during the process of assembling the scissors-type support member, the possibility of damaging the outer frame 23 is minimized. In particular, it is very simple to assemble the scissors-type support member of the present invention by inserting the inner frame 22 into the outer frame 23 in a crisscrossing manner and turning over the inner frame 22 by an angle. That is, the process of assembling the scissors-type support member of the present invention could be automated and thus the throughput of the key structure or the keyboard is enhanced.

After the scissors-type support member is assembled, the scissors-type support member is fixed on the base plate 26 via the engagement between the hook 261 and the second gliding shaft 235 and the engagement between the first coupling shaft 224 and the second connecting part 262. Next, via the engagement between the guiding slot 212 and the first gliding shaft 225 and the engagement between the first connecting part 211 and the second coupling shaft 234, the keycap 21 is combined with the scissors-type support member.

Figure 6A:
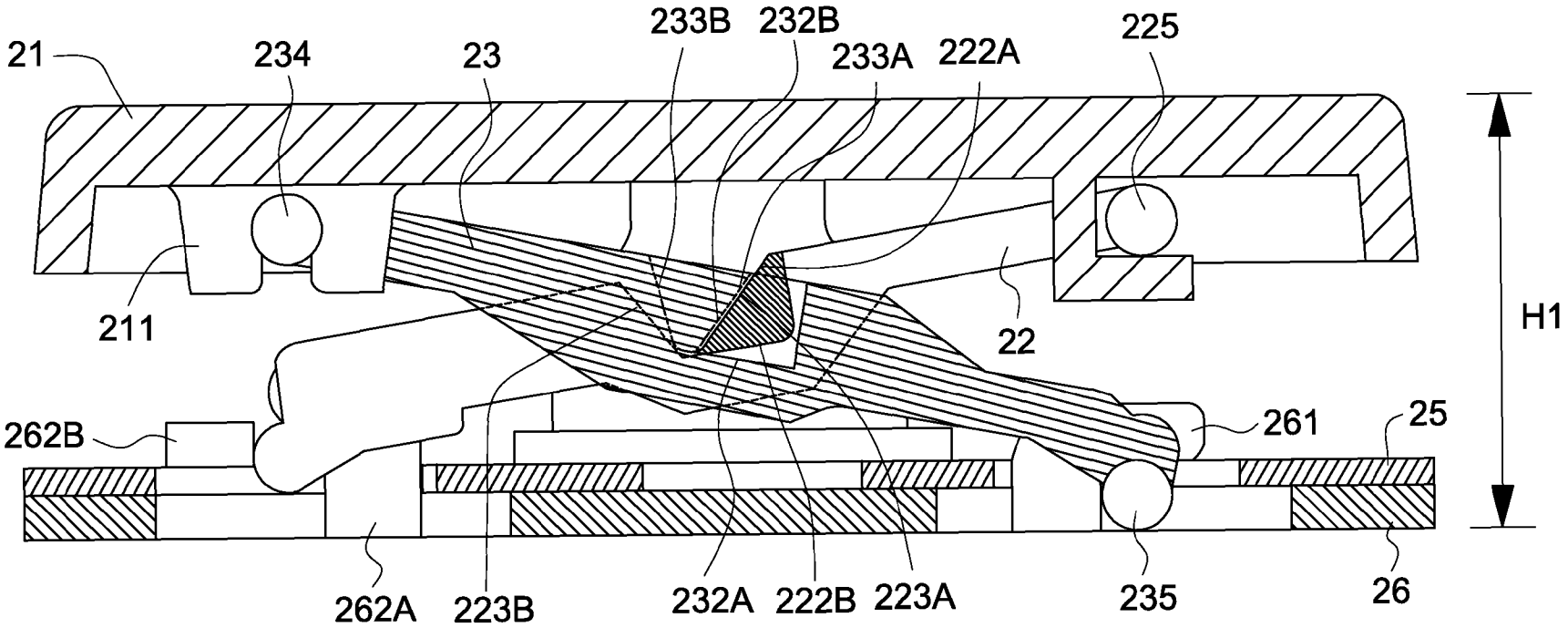
FIG. 6A is a schematic cross-sectional view illustrating the key structure of the present invention that is not depressed.
Figure 6B:
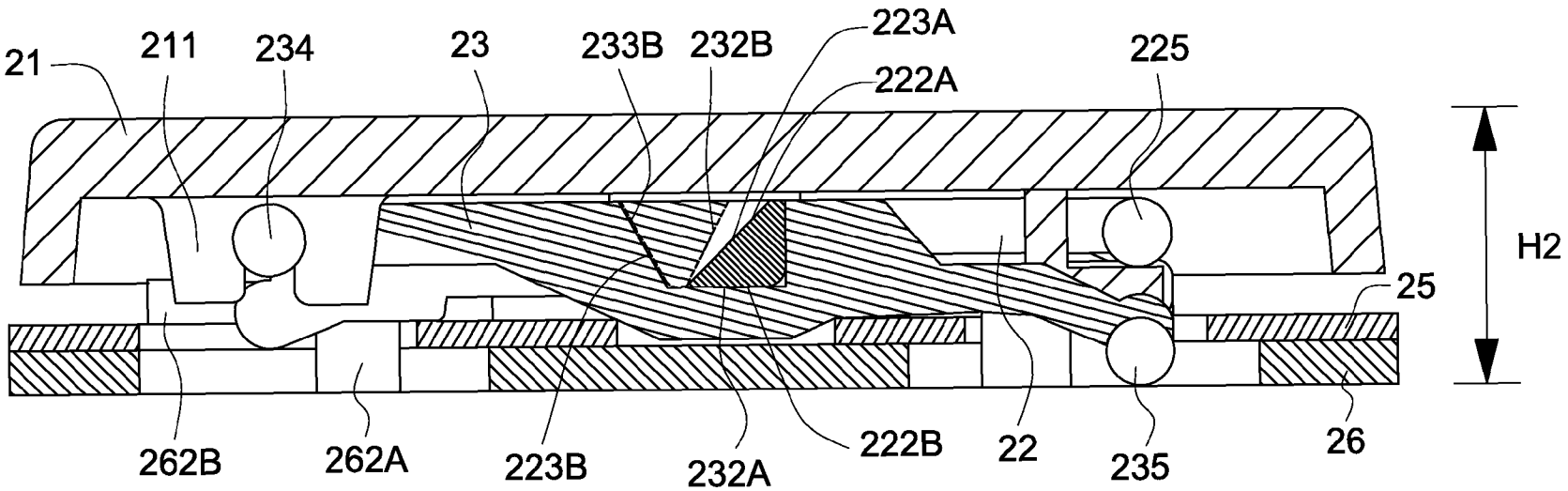
FIG. 6B is a schematic cross-sectional view illustrating the key structure of the present invention that has been depressed.

FIG. 6A is a schematic cross-sectional view illustrating the key structure of the present invention that is not depressed. FIG. 6B is a schematic cross-sectional view illustrating the key structure of the present invention that has been depressed. The use of the scissors-type support member to balance the keycap 21 and achieve a desired tactile feel will be illustrated with reference to FIG. 6A and FIG. 6B.

In a case that the keycap 21 is not depressed, the keycap 21 is located at a first height H1 with respect to the bottom of the base plate 26. As shown in FIG. 6A, the first inclined surface 222A of the first convex part 222 of the inner frame 22 is sustained against the second inclined surface 232B of the recess 232 of the outer frame 23. At this moment, the fifth inclined surface 233A of the second convex part 233 of the outer frame 23 is also sustained against the third inclined surface 223A of the V-shaped notch 223 of the inner frame 22. Whereas, when the keycap 21 is depressed, the height of the keycap 21 with respect to the bottom of the base plate 26 is lowered from the first height H1 to a second height H2. As shown in FIG. 6B, the first bottom surface 222B of the first convex part 222 of the inner frame 22 is sustained against the second inclined surface 232B of the recess 232 of the outer frame 23. At this moment, the sixth inclined surface 233B of the second convex part 233 of the outer frame 23 is engaged with the fourth inclined surface 223B of the V-shaped notch 223 of the inner frame 22.

From the above description, since the inner frame 22 and the outer frame 23 are contacted with each other by a surface-to-surface contacting manner during the keycap 21 is vertically moved, the scissors-type support member of the present invention is more stable and the rocking phenomenon is minimized. The surface-to-surface contacting manner increases the contact area between the inner frame 22 and the outer frame 23, and thus the stability of the scissors-type support member is enhanced. Moreover, since the inner frame 22 is not pivotally coupled with the outer frame 23, the first convex part 222 of the inner frame 22 is nearly not contacted with the recess 232 of the outer frame 23 during the keycap 21 is moved from the first height H1 to the second height H2 or from the second height H2 to the first height H1. As a consequence, the abrasion of the scissors-type support member is largely reduced and the use life of the keycap is extended. Moreover, by using the scissors-type support member of the present invention, a desired tactile feel when the keycap is depressed will be achieved.

For further reducing the abrasion between the inner frame 22 and the outer frame 23 and facilitating assembling the scissors-type support member, the scissors-type support member of the key structures 2 could be modified. For example, fillets could be optionally formed at the surface-to-surface joints of the first convex part 222 and the V-shaped notch 223 of the inner frame 22 and the recess 232 and the second convex part 233 of the outer frame 23. For example, fillets could be formed at the joints between the first inclined surface 222A and the first bottom surface 222B of the first convex part 222 of the inner frame 22, between the third inclined surface 223A and the fourth inclined surface 223B of the V-shaped notch 223 of the inner frame 22, between the second bottom surface 232A and the second inclined surface 232B of the recess 232 of the outer frame 23, or between the fifth inclined surface 233A and the sixth inclined surface 233B of the second convex part 233 of the outer frame 23.

The key structure 2 of the present invention could be applied to a keyboard. That is, the keyboard has a plurality of key structures 2 of the present invention. An example of the keyboard includes but is not limited to a desktop keyboard, a number pad or a notebook keyboard.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure comprising:

a keycap;

a base plate; and a scissors-type support member for connecting said keycap with said base plate, said scissors-type support member comprising:

an inner frame having a first convex part and an internally-concave V-shaped notch formed on an arm part of said inner frame, wherein said first convex part comprises a first inclined surface and a first bottom surface; and an outer frame having an internally-concave recess and a second convex part formed on an arm part of said outer frame, said recess comprising a second bottom surface and a second inclined surface, wherein when said keycap is located at a first height with respect to said base plate, said first inclined surface is sustained against said second inclined surface, and when said keycap is located at a second height with respect to said base plate, said first bottom surface is sustained against said second bottom surface.

2. The key structure according to claim 1 wherein said second convex part is a triangular prism having a fifth inclined surface extended from said second inclined surface, said triangular prism is accommodated within said V-shaped notch, and said V-shaped notch has a third inclined surface extended from said first inclined surface, wherein said fifth inclined surface is sustained against said third inclined surface when said keycap is located at said first height.

3. The key structure according to claim 2 wherein said triangular prism further includes a sixth inclined surface, and said V-shaped notch further includes a fourth inclined surface, wherein said sixth inclined surface is sustained against said fourth inclined surface when said keycap is located at said second height.

4. The key structure according to claim 1 further comprising:

a membrane switch disposed on said base plate; and an elastic element arranged between said keycap and said membrane switch, wherein said membrane switch is triggered by said elastic element when said keycap is depressed to be moved from said first height to said second height.

5. The key structure according to claim 1 wherein a first connecting part and a guiding slot are formed on a bottom of said keycap, a second connecting part and a hook are formed on said base plate, a first coupling shaft and a first gliding shaft are formed on both terminals of said arm part of said inner frame, and a second coupling shaft and a second gliding shaft are formed on both terminals of said arm part of said outer frame, wherein said scissors-type support member is fixed on said base plate via the engagement between said hook and said second gliding shaft and the engagement between said second coupling shaft and said first connecting part, and said keycap is combined with said scissors-type support member via the engagement between said guiding slot and said first gliding shaft and the engagement between said first connecting part and said second coupling shaft.

6. A keyboard comprising:

multiple keycaps;

a base plate;

a plurality of scissors-type support members for connecting said keycaps with said base plate, each of said scissors-type support members comprising:

an inner frame having a first convex part and an internally-concave V-shaped notch formed on an arm part of said inner frame, wherein said first convex part comprises a first inclined surface and a first bottom surface; and an outer frame having an internally-concave recess and a second convex part formed on an arm part of said outer frame, said recess comprising a second bottom surface and a second inclined surface, wherein when said keycap is located at a first height with respect to said base plate, said first inclined surface is sustained against said second inclined surface, and when said keycap is located at a second height with respect to said base plate, said first bottom surface is sustained against said second bottom surface;

a plurality of membrane switches disposed on said base plate; and a plurality of elastic elements arranged between respective keycaps and respective membrane switches, wherein said membrane switches are triggered by said elastic elements when corresponding keycaps are depressed to be moved from said first height to said second height.

7. The keyboard according to claim 6 wherein said second convex part is a triangular prism having a fifth inclined surface extended from said second inclined surface, said triangular prism is accommodated within said V-shaped notch, and said V-shaped notch has a third inclined surface extended from said first inclined surface, wherein said fifth inclined surface is sustained against said third inclined surface when said keycap is located at said first height.

8. The keyboard according to claim 7 wherein said triangular prism further includes a sixth inclined surface, and said V-shaped notch further includes a fourth inclined surface, wherein said sixth inclined surface is sustained against said fourth inclined surface when said keycap is located at said second height.

9. The keyboard according to claim 6 wherein a first connecting part and a guiding slot are formed on a bottom of said keycap, a second connecting part and a hook are formed on said base plate, a first coupling shaft and a first gliding shaft are formed on both terminals of said arm part of said inner frame, and a second coupling shaft and a second gliding shaft are formed on both terminals of said arm part of said outer frame, wherein said scissors-type support member is fixed on said base plate via the engagement between said hook and said second gliding shaft and the engagement between said second coupling shaft and said first connecting part, and said keycap is combined with said scissors-type support member via the engagement between said guiding slot and said first gliding shaft and the engagement between said first connecting part and said second coupling shaft.

* * * * *